US009095751B2

(12) United States Patent
Baumann

(10) Patent No.: US 9,095,751 B2
(45) **Date of Patent: *Aug. 4, 2015**

(54) GOLF CLUB PUTTER

(76) Inventor: Peter Baumann, Yreka, CA (US)

( * ) Notice: Subject to any disclaimer, the term of this patent is extended or adjusted under 35 U.S.C. 154(b) by 120 days.

This patent is subject to a terminal disclaimer.

(21) Appl. No.: 13/567,293

(22) Filed: Aug. 6, 2012

(65) Prior Publication Data

US 2013/0210540 A1 Aug. 15, 2013

Related U.S. Application Data

(63) Continuation-in-part of application No. 13/372,666, filed on Feb. 14, 2012.

(51) Int. Cl.

| | |
|---|---|
| ***A63B 53/10*** | (2006.01) |
| ***A63B 53/00*** | (2015.01) |
| ***A63B 53/02*** | (2015.01) |
| *A63B 53/14* | (2015.01) |

(52) U.S. Cl.

CPC ..... *A63B 53/007* (2013.01); *A63B 53/02* (2013.01); *A63B 53/10* (2013.01); *A63B 53/14* (2013.01); *Y10T 29/4998* (2015.01)

(58) Field of Classification Search

CPC ..... A63B 53/007; A63B 53/02; A63B 53/10; A63B 53/14; Y10T 29/4998

See application file for complete search history.

(56) References Cited

U.S. PATENT DOCUMENTS

| | | | | |
|---|---|---|---|---|
| 3,392,977 | A * | 7/1968 | De Lacey | 473/306 |
| 4,795,158 | A * | 1/1989 | Kuykendall | 473/201 |
| 5,156,396 | A * | 10/1992 | Akatsuka et al. | 473/319 |
| 5,253,868 | A | 10/1993 | Baumann et al. | |
| 5,257,807 | A | 11/1993 | Baumann et al. | |
| 5,427,373 | A * | 6/1995 | Kusumoto | 473/319 |
| 5,573,468 | A | 11/1996 | Baumann | |
| 5,653,645 | A | 8/1997 | Baumann | |
| 5,695,408 | A * | 12/1997 | DeLaCruz et al. | 473/300 |
| 5,797,176 | A * | 8/1998 | Rose et al. | 29/527.5 |
| 6,261,500 | B1 * | 7/2001 | Park et al. | 264/258 |
| 6,857,972 | B2 * | 2/2005 | Kumamoto | 473/319 |
| 7,048,645 | B2 * | 5/2006 | Kumamoto | 473/319 |
| 7,204,765 | B2 * | 4/2007 | Cover et al. | 473/244 |
| 2002/0072430 | A1 * | 6/2002 | Bullock et al. | 473/313 |
| 2003/0144077 | A1 * | 7/2003 | Cullen | 473/340 |
| 2006/0128498 | A1 * | 6/2006 | Reese | 473/340 |
| 2012/0077609 | A1 * | 3/2012 | Tonkin | 473/236 |

* cited by examiner

*Primary Examiner* — Stephen Blau

(74) *Attorney, Agent, or Firm* — Troutman Sanders LLP; James M. Bollinger; Louis J. DelJuidice

(57) ABSTRACT

A golf club putter includes a clubhead body sufficiently weighted to define a center of gravity of the golf club, which center of gravity may be adjusted for left and right handed golfers. The putter includes a graphite or fiberglass composite shaft, elongated along a central axis continuously tapering radially inwardly, from: a larger outside diameter adjacent a tip end attached to the clubhead body, to: a smaller outside diameter adjacent a grip end. Preferably, the composite shaft is reverse tapered. The reverse tapered shaft comprises longitudinally oriented graphite or fiberglass fibers in an arrangement that enables shaft torsional distorting forces imposed at the grip end during putting to be imparted to the clubhead and a golf ball thereby.

7 Claims, 18 Drawing Sheets

FIG. 6
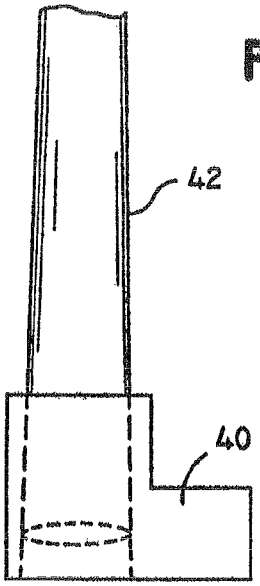
FIG. 9
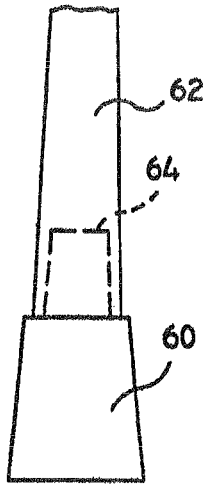
FIG. 7
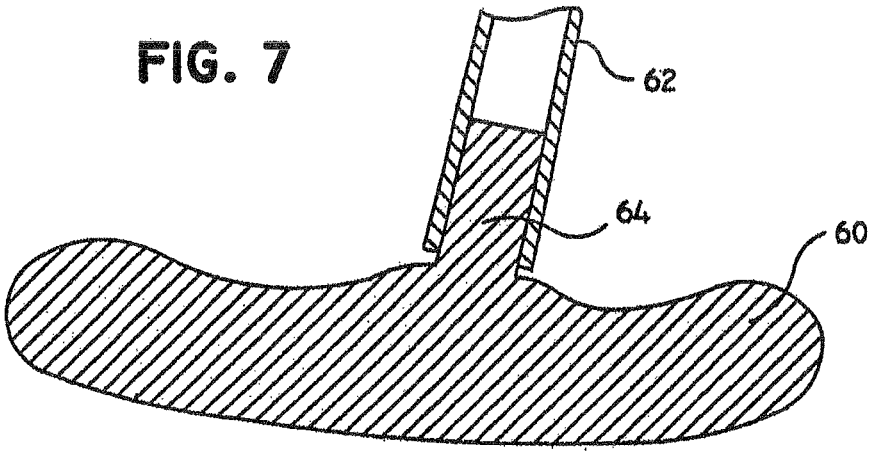
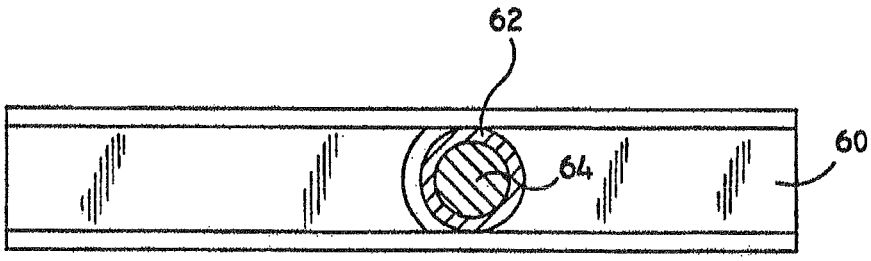
FIG. 8

GOLF CLUB PUTTER

CROSS-REFERENCE TO RELATED APPLICATION

This application is a continuation-in-part (CIP) application of U.S. patent application Ser. No. Ser. No. 13/372,666, filed Feb. 14, 2012 ("the parent application"), and claims priority from the parent application under 35 USC §120.

BACKGROUND OF THE INVENTION

The present invention relates to golf clubs broadly and, more particularly, to a golf club putter configured to impart spin on a golf ball to reduce breaking to either the left or the right, depending on putting conditions.

Reversed shaft golf club putters are known. For Example, U.S. Pat. No. 5,253,868 to Baumann, et al. (The '868 patent) discloses a golf club putter including a reversed tapered shaft with a thin end in the grip and a thick end in the head. The head can includes a hollow construction at the exact center of the head to realize a true and exact toe-heel balance relative to a shaft. The description below and FIGS. 1-13 herein, describe the various embodiments of the '868 patent.

U.S. Pat. No. 5,257,807 to Baumann, et al. (the '807 patent) discloses further improvements to the golf club putter first disclosed in the '868 patent. That is, the golf club putter of the '868 patent discloses a reversed shaft with a thin end in the grip and a thick end in the head, where the head displays a hollow construction at its exact center thereby providing the putter head with a true and exact toe-heel balance relative to a shaft. The description below and FIGS. 14-24 herein, describe the various embodiments of the '807 patent.

FIG. 1 illustrates a side view of a mallet putter 10 including a reversed tapered shaft 12, a grip 14 and a mallet putter head 16. The reversed tapered shaft 12 is of a downwardly increasing radius, i.e., the radius of the tapered shaft 12 is the least at a point nearest the grip 14 and the greatest at its lower end near the lower region of the mallet putter head 16.

FIG. 2 illustrates a cross-sectional view of the mallet putter head 16 formed with bronze or other suitable material and a hollow construction at the exact center of the head to provide the putter head with a true and exact toe-heel balance relative to the shaft. This true toe-heel balance provides users with better accuracy when striking putts exactly opposite the shaft, at the center of the face as well as an option of addressing and striking the ball at designated points on the toe or the heel to reduce the amount of break in breaking puffs. This putter allows a right-handed putter to address and strike the ball at the toe of the putter blade when confronted with a right to left breaking putt to reduce the amount of break in the putt. Similarly, the putter allows the user to address and strike the ball at the heel of the putter when confronted with left to right breaking putts, thus reducing the amount of break in said putts. The same principle applies to left-handed putters using the opposite face.

A hole 18 is canted approximately 5° and is located in the bottom surface 20 in alignment with another smaller radius canted hole 22 in the neck 24 of the mallet putter head 16. The holes 18 and 22 are aligned and properly sized to frictionally engage the taper of the tapered shaft 12 in order to form a strong mechanical union of the tapered shaft 12 and the mallet putter head 16 without the use of fastening devices, such as screws, adhesives or the like. A weight 26, such as lead or other suitable material, can reside in the lower end of the tapered shaft 12 between holes 22 and 18 for a weighted feel of the mallet putter 10. A plastic plug 28 can also secure in the bottom end of the tapered shaft 12 for containment of the weight 26 in the lower region of the tapered shaft 12. The tapered shaft 12 is aligned at the true center of gravity of the mallet putter head 16. FIG. 3 illustrates a top view in cross section of the mallet putter head 16.

Since the shaft meets the head of the putter at the true center of gravity, the golfer can address and make contact with the ball at any one of three locations. The first location is at the center of the head for straight putts. The second location is at the toe to reduce the break for right to left breaking putts for right-handed golfers. The third location is at the heel to reduce the break in left to right breaking putts for right-handed golfers. A hollow area in the center of the head can also be provided to maximize toe to heel weighting benefit providing for the above contact points with the ball at any of the three locations listed above.

FIG. 4 illustrates a front view of a block putter head 40 used with a tapered shaft 42 being in all respects similar to the tapered shaft 12 in FIG. 1. An optional hollow volume 52, as illustrated in dashed lines, can be utilized in the golf club putter of the present invention.

FIG. 5 illustrates a back view in cutaway of the block putter head 40 in frictional engagement with a tapered shaft 42. A canted and tapered hole 44 in the body of the block putter head 40 includes a ridge 46 for seating of the end of the tapered shaft 42. A plastic plug 48 suitably engages the lower end of the tapered shaft 42 to contain a weight 50 in the lower end of the tapered shaft 42. The weight 50 may be varied to afford the desired feel for the individual golfer. FIG. 6 illustrates an end view of FIG. 4.

FIG. 7 illustrates a side view of a thin blade balanced bronze putter head 60 in use with a tapered shaft 62, which in all respects is similar to the tapered shaft 12 of FIG. 1 with the exception of the method of mounting to the thin blade putter head 60. An integral tapered shaft 64 extends at an appropriate angle from the thin blade putter head 60 to glue, or other adhesive materials, the lower end of tapered shaft 62. In the alternative, the upwardly extending shaft can be a pin or stub on the top of the head. FIG. 8 illustrates a top view of FIG. 7, and FIG. 9 illustrates an end view of FIG. 8.

FIG. 10 illustrates a perspective view of a golf club putter 100, the third alternative embodiment, including a head 102, a reversed shaft 104, and a grip 106. A hollow area 108 is provided in the head 102. A hole 110 is provided to engage with the shaft 104. The thick end of the shaft 112 engages into the hole 110, and the thin end of the shaft 114 engages into the grip 106. An upwardly extending member 116 provides further support for the thick end of the shaft 112. The shaft 104 is inserted through the head 110 at a true center of gravity. The hollow area 108 can be filled with any suitable material, such as material of a different density than that of the material the head 102. FIG. 11 illustrates a front view of the head 102 of FIG. 10.

FIG. 12 illustrates a top view of the head 102 of FIG. 11, wherein alignment lines 118 and 120 are provided for the precise striking of the ball as previously discussed in the mode of operation. The alignment lines toward the toe for right to left breaking putts, and at the alignment line toward the heel for left to right breaking putts. FIG. 13 illustrates a bottom view of the head 102 of FIG. 11.

The reversed shaft (thin end in the hands and fat end at the head) enables one to stroke putts more smoothly. The flex is near the hands, thus dampening any shakiness in the stroke by the time the stroke reaches the head. This reduces or eliminates the "yips". Most previous putter designs have a "toe-heavy" head in relation to the shaft. Balance the putter shaft in one's palm and the toe does not dip downward. The golf club putter is the first true putter with the shaft entering the head at the center of gravity. The result is a true toe-heel balance that keeps one's putts starting where one wants them to start, and rolling forward, without any side spin.

Most other putters, being toe-heavy, cause the head to open at impact. That is why right-handed putters like right-to-left breaking putts. The face opening at impact puts side spin on the ball that reduces the break in the putt. One knows that the less a putt breaks, the better the chances of making it. In this case the toe-heavy putter head causes the putt to break more than normal for left to right breaking putts. With the golf club putter of the present invention, true center of gravity putter, merely address and stroke the ball at the center of the face for a straight putt, at the alignment line toward the toe for right-to-left breaking putts, and at the alignment line toward the heel for those dreaded left-to-right breaking putts. If one is pushing one's putts, simply address and stroke the ball off of the alignment line on the heel of the golf club putter. The balance of the golf club putter moves the ball back on line. If one is pulling one's putt, simply address and stroke the ball off the alignment line at the toe of the golf club putter. The balance in the head will push the putt back on line.

FIG. 14 illustrates a side view of a golf club putter 150, the fourth alternative embodiment, including a head 152, a reversed shaft 154, and a grip 156. A hollow area 158 is provided in the upper region of the head 152. A shaft mounting hole 160 extends to the bottom surface 166 to engage the reversed shaft 154. The thick end 162 of the reversed shaft 154 engages the shaft mounting hole 160 and the thin end 164 of the shaft engages the grip 156. The reversed shaft 154 is inserted through the shaft mounting hole 160 at a true center of gravity. The hollow area 158 can be filled with any suitable material, such as material of a different density than that of the material of the head 152. A smooth bottom surface 166 is included on the bottom surface of the head 152 to be broken only by the bottom edge of the shaft mounting hole 160.

FIG. 15 illustrates a front view of the head 152 of FIG. 14 and FIG. 16 illustrates a top view. Alignment lines 170 and 172 are provided for the precise striking of the ball as previously discussed in the mode of operation. The alignment lines toward the toe for right to left breaking putts, and at the alignment line toward the heel for left to right breaking putts. FIG. 17 illustrates a bottom view of the head 152. The mode of operation is similar to that of the mode of operation previously described for FIGS. 10-13.

FIG. 18 illustrates a side view of a head 200, to be used in lieu of the head 152 with a golf club putter 150 as illustrated in FIG. 14. A hollow area 202 is provided in the upper region of the head 200. A shaft mounting hole 204 extends partially through the head and is provided to engage the reversed shaft 154 of FIG. 14. The thick end 162 of the shaft 154 engages the shaft mounting hole 204. The reversed shaft 154 is inserted into the shaft mounting hole 204 at a true center of gravity. The hollow area 202 can be filled with any suitable material, such as material of a different density than that of the material of the head 200. A completely smooth surface 206, having no intermediate surface edges, is included on the bottom of the head 200. This is an important factor as no extraneous bottom surfaces are present which would hinder an otherwise good putt shot due to extraneous contact of intermediate edges with the putting green grass or other course obstacles.

FIG. 19 illustrates a top view of the head 200 of FIG. 18, wherein alignment lines 210 and 212 are provided for the precise striking of the ball as previously discussed in the mode of operation. The alignment lines toward the toe for right to left breaking putts, and at the alignment line toward the heel for left to right breaking putts. FIG. 20 illustrates a bottom view of the head 200 of FIG. 18 to highlight the smooth surface 206 which is free of intermediate surface edge lines. The mode of operation is similar to that of the mode of operation previously described in FIGS. 10-13.

FIG. 21 illustrates a side view of a head 250, to be used in lieu of the head 152 with a golf club putter 150, as illustrated in FIG. 14. A hollow area 252 is provided in the upper region of the head 250. A shaft mounting hole 254 extends partially through the head 250 and is provided to engage the reversed shaft 154 of FIG. 14. The thick end 162 of the reversed shaft 154 engages the shaft mounting hole 254. The reversed shaft 154 is inserted into the shaft mounting hole 254 at a true center of gravity. The hollow area 252 can be filled with any suitable material, such as material of a different density than that of the material of the head 252. A completely smooth surface 256, having no intermediate surface edges, is included on the bottom of the head 250. This is an important factor as no extraneous bottom surfaces are present which would hinder an otherwise good putt shot due to extraneous contact of intermediate edges with the putting green grass or other course obstacles. Beveled end surfaces 258 and 260 are located between beveled sides 262 and 264 of the head 250. The beveled surfaces, such as surface 258, are employed to contact a ball lying at the very edge of the putting green and in contact with the grass surrounding the putting green as illustrated in FIG. 24.

FIG. 22 illustrates a top view of the head 250 of FIG. 21 where alignment lines 266 and 268 are provided for the precise striking of the ball as previously discussed in the mode of operation. The alignment lines toward the toe for right to left breaking putts, and at the alignment line toward the heel for left to right breaking putts. FIG. 23 illustrates a bottom view of the head 250 of FIG. 21 where smooth surface 206 is free of intermediate surface edge lines. The mode of operation is similar to that of the mode of operation previously described for FIGS. 10-13.

In addition, FIG. 24 illustrates the use of the beveled end surface 258 to strike a golf ball 270 lying on a putting green 272 and adjacent to and up against the grass area 274 consisting of taller and heavier grass which surrounds the putting green 272. Traditional putting would normally employ one of the beveled side surfaces 262 and 264 to contact the golf ball 270. The relatively large surface area of the beveled side surfaces 262 or 264 encounter a large amount of grass resistance to the swing due to the large barrier presented by the tall grass 274 adjacent to the golf ball 270 which interferingly contacts the corresponding facial area of the beveled side surface 262. It can be clearly seen that the incorporation of the beveled end surface 258 to contact the golf ball 270 presents a much smaller frontal planar area which easily parts and passes through the tall grass 274 with much less resistance than the former case incorporating the larger planar surface 262 or 264.

SUMMARY OF THE INVENTION

While the aforementioned golf club putters provide certain control by identifying the position of the clubhead, with respect to the clubhead center of gravity, for example, by striking a ball forward of the center of gravity (at the toe) to reduce the break for right to left breaking putts, or behind the center of gravity (at the heel) to reduce the break in left to right breaking putts, they do not provide a means for adding controlled torque, or break in a put to compensate for a putting green sloped to the right or the left.

The present invention provides improvements over the prior art reversed shaft golf club putters.

The inventive golf club putter so designed enables a right-handed golfer to strike the ball off the toe to impart a clockwise spin on the ball and reduce any break to the left that might be imposed by a left sloping green. In addition, where the golfer is confronted with a green that slopes to the right, the inventive golf club putter so designed enables striking the ball off the heel to impart a counter clockwise spin on the ball and reduce any break to the right. Reducing break in a putt makes it easier to make the putt.

In an embodiment, a graphite golf club includes a clubhead body sufficiently weighted to define a center of gravity of the golf club. A reverse tapered graphite shaft elongated along a central axis continuously tapering radially inwardly, from: a larger outside diameter adjacent a tip end attached to the clubhead body, to: a smaller outside diameter adjacent a grip end. The reverse tapered graphite shaft comprises longitudinally oriented graphite fibers in an arrangement that enables shaft torsional distorting forces imposed at the grip end during putting to be imparted to the clubhead and a golf ball thereby.

In another embodiment, the invention includes a process for manufacturing a graphite golf club that enables shaft torsional distorting forces imposed at the grip end during putting to be imparted to the clubhead and a golf ball thereby.

In another embodiment, the invention provides a process for manufacturing a composite golf club putter configured to enable shaft torsional distorting forces imposed at the grip end during putting to be transmitted to the clubhead in such a way in that, depending on whether the clubhead strikes a golf ball, from the left or right, and at a toe or heel of the clubhead, a spin is imparted to golf ball. The process comprises forming a composite shaft elongated along a central axis with longitudinally oriented fibers, forming a clubhead body sufficiently weighted to define a center of gravity of the clubhead and connecting the clubhead body to a tip end of the composite shaft in order to facilitate said shaft torsional distorting forces.

Preferably, the step of connecting includes that the location of the tip end of the composite shaft is equidistant from the toe or heel of the clubhead body but closer to one clubhead face than the other clubhead face in order that the composite golf club putter may be used with either left-handed or right-handed golfers. For that matter, the step of forming the composite shaft may define a shaft shape in any of the group consisting of a reverse taper by which the shaft continuously tapers radially inwardly from a larger outside diameter adjacent a tip end attached to the clubhead body to a smaller outside diameter adjacent a grip end, a taper by which the shaft continuously tapers radially outwardly from a smaller outside diameter adjacent a tip end attached to the clubhead body to a larger outside diameter adjacent a grip end, and no taper where the outside diameter is substantially the same from the outside diameter adjacent a tip end attached to the clubhead body to the outside diameter adjacent a grip end.

In yet another embodiment, the invention provides a composite golf club putter with a clubhead body sufficiently weighted to define a center of gravity of the golf club; and a composite shaft elongated along a central axis between a tip end attached to the clubhead body and a grip end. The composite shaft comprises longitudinally oriented fibers in an arrangement that enables shaft torsional distorting forces imposed at the grip end during putting to be imparted to the clubhead body and a golf ball, wherein the longitudinally oriented fibers are low modulus fibers displaying minimal torsional resistance.

Preferably, the composite shaft is cylindrical, with shaft walls surrounding a hollow center, wherein the shaft walls are of a thickness equivalent to a range of between ¼ and 1/10 of the shaft radius. For that matter, the composite golf club putter where the composite includes material from any of the group consisting of graphite, fiberglass and both and wherein the fibers comprise any of the group consisting of graphite fibers, fiberglass fibers and both. A tip end of the composite shaft is positioned in the clubhead body at a location that is equidistant from the toe or heel but closer to one clubhead face than the other clubhead face in order that the composite golf club putter may be used with either left-handed or right-handed golfers.

Also, the longitudinally oriented fibers and the position of the tip end in the clubhead body enable shaft torsional distorting forces imposed at the grip end during putting to be transmitted to a striking surface of the clubhead in such a way that, depending on whether the clubhead striking surface strikes a golf ball, from the left or right, and at a toe or heel of the clubhead, a spin is imparted to the golf ball.

BRIEF DESCRIPTION OF THE DRAWINGS

The present invention can best be understood in connection with the accompanying drawings. It is noted that the invention is not limited to the precise embodiments shown in drawings, in which:

FIG. 6 illustrates an end view of FIG. 4;

FIG. 7 illustrates a side view of a thin blade putter in use with a reversed tapered shaft;

FIG. 8 illustrates a top view of FIG. 7;

FIG. 9 illustrates an end view of FIG. 8;

DETAILED DESCRIPTION OF THE INVENTION

Figure 1:
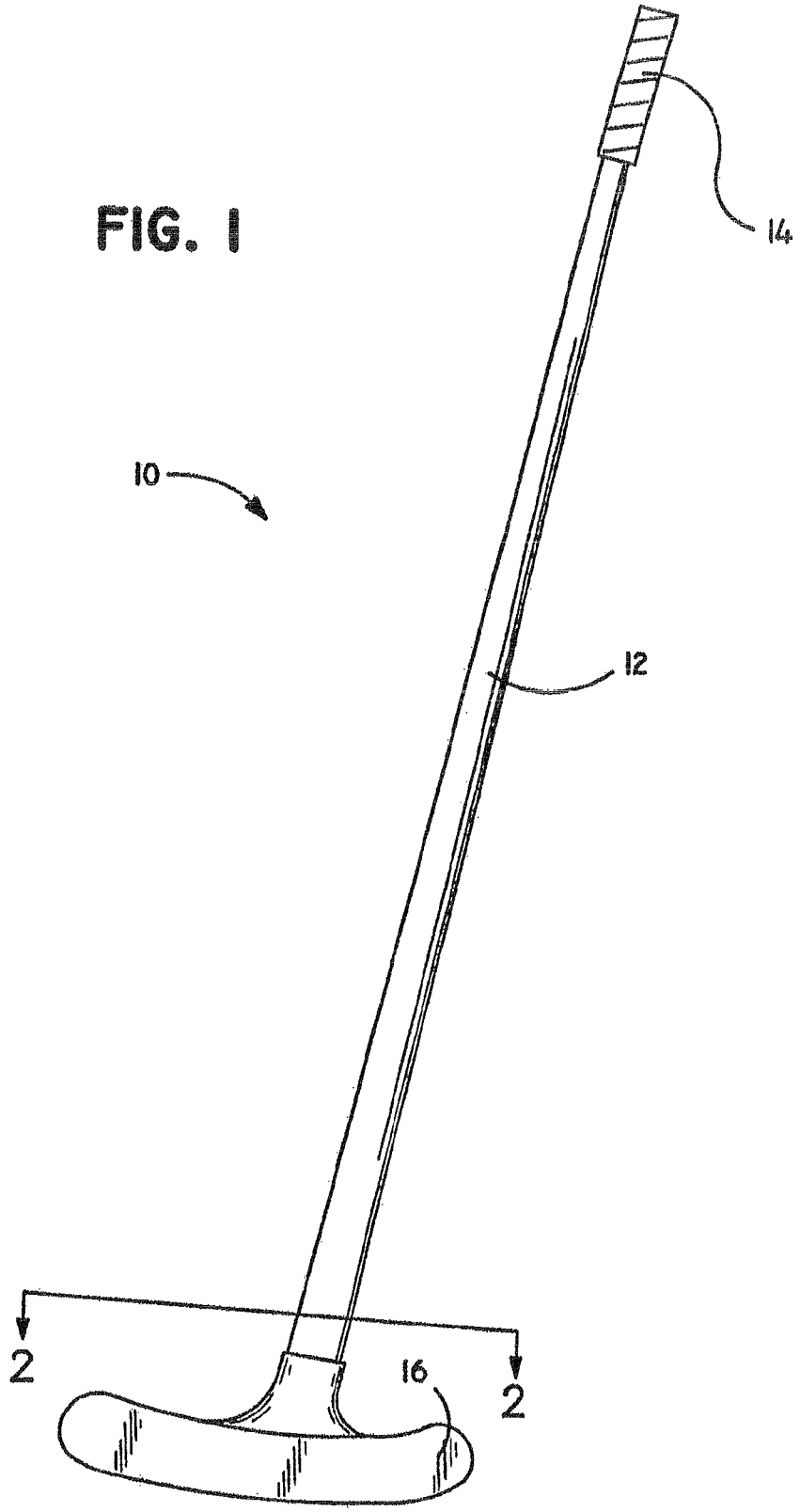
FIG. 1 illustrates a side view of a reversed taper shaft mallet putter.
Figure 2:
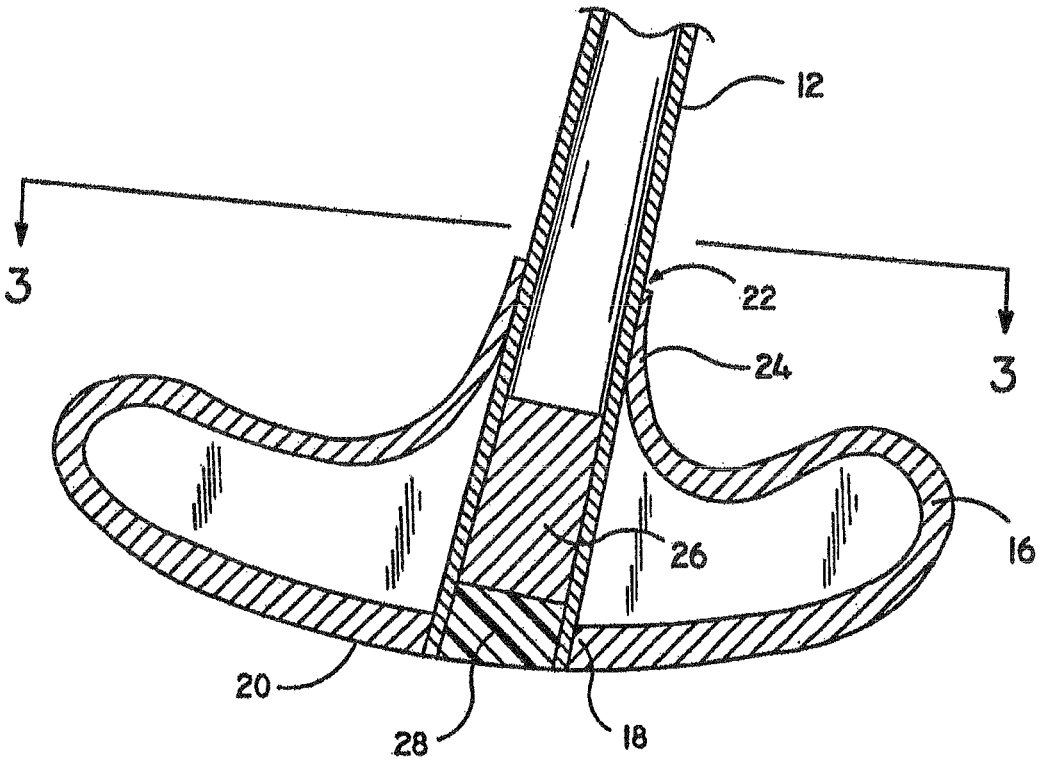
FIG. 2 illustrates a cross-sectional view of the reversed taper shaft mallet putter along lines 2-2 of FIG. 1.
Figure 3:
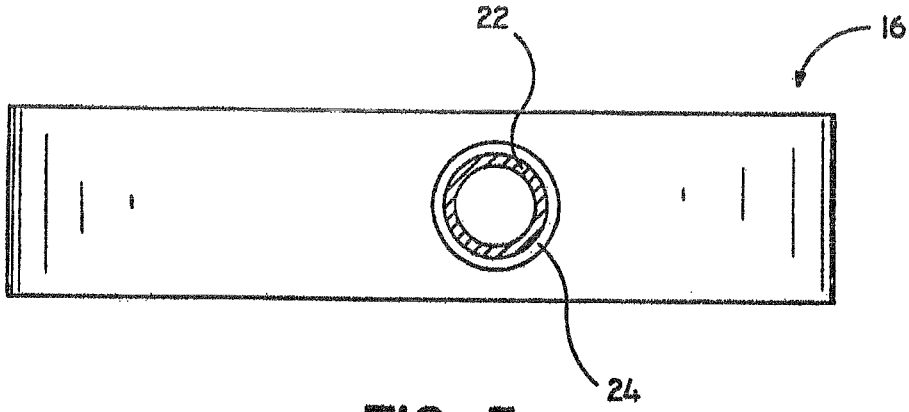
FIG. 3 illustrates a top view in cross section of the reversed taper shaft mallet putter along lines 3-3 of FIG. 2.
Figure 4:
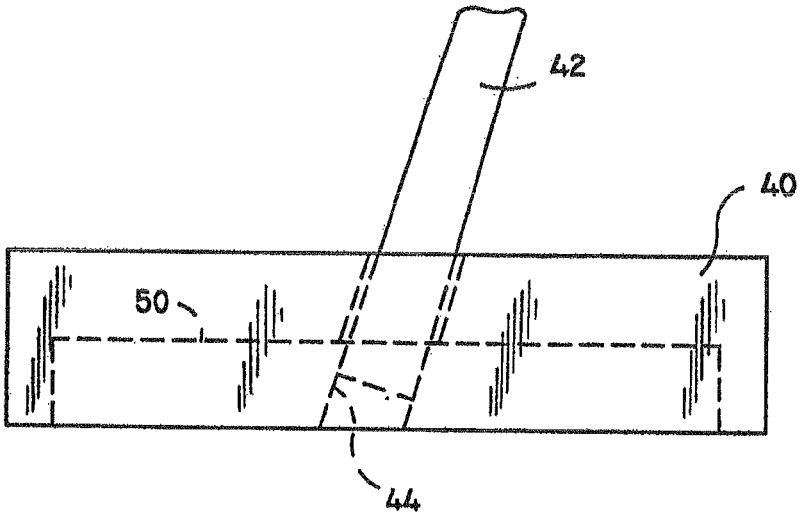
FIG. 4 illustrates a front view of a block head putter in use with a reversed tapered shaft.
Figure 5:
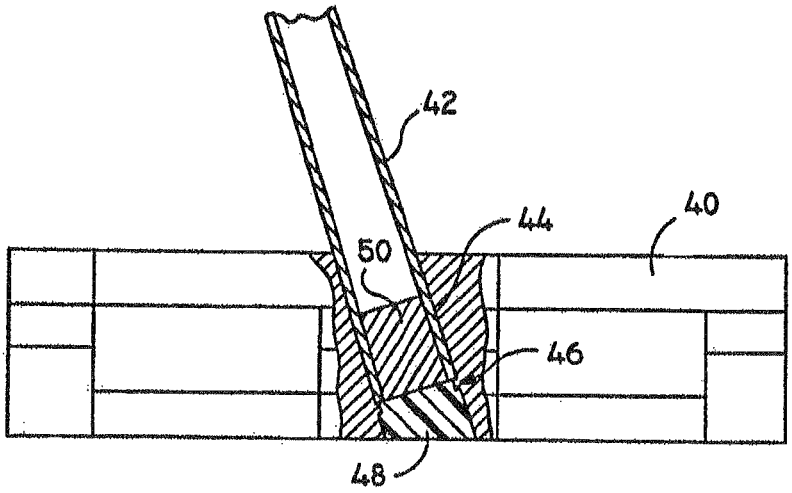
FIG. 5 illustrates a back view in cross section of FIG. 4.
Figure 10:
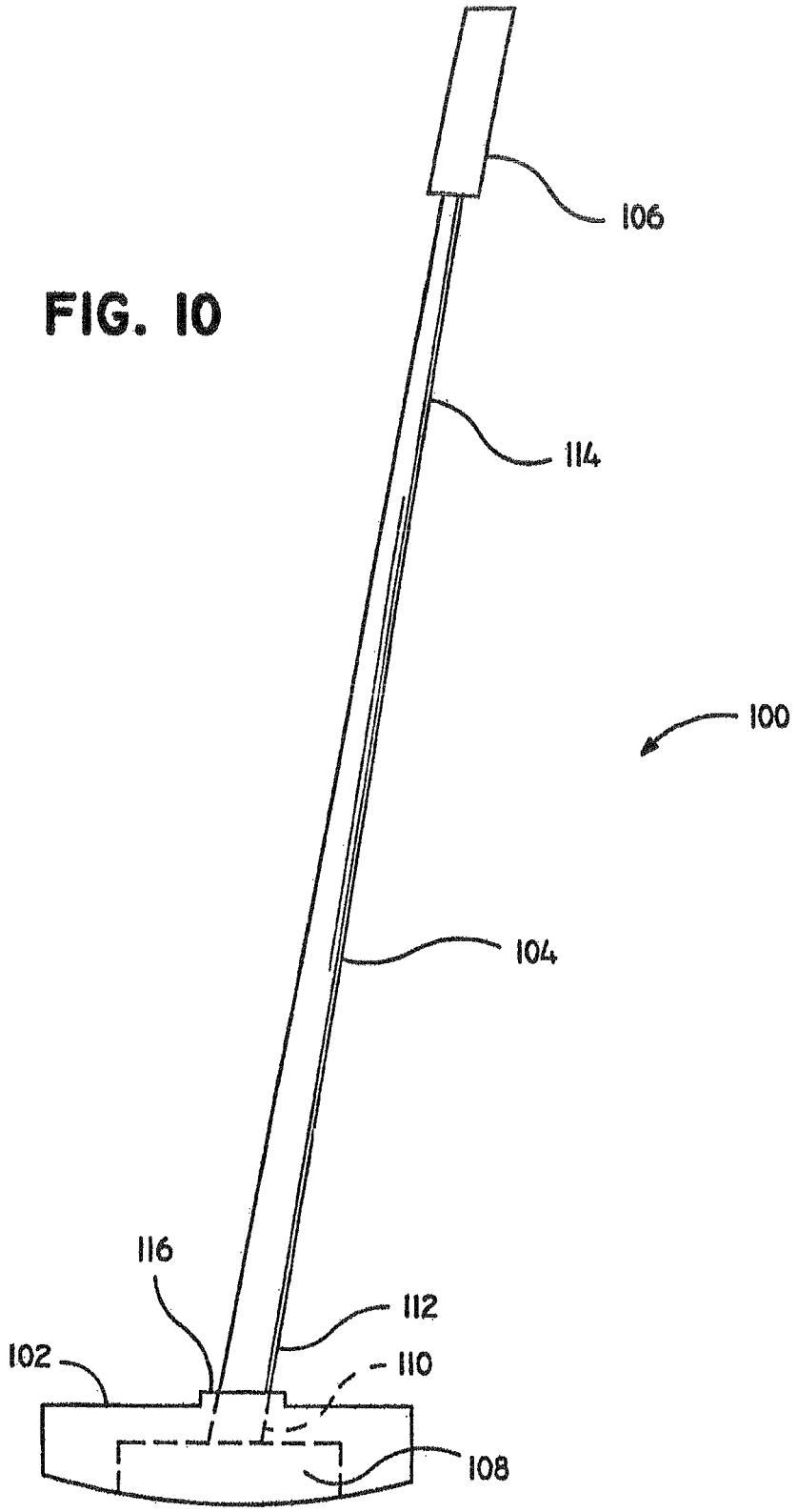
FIG. 10 illustrates a side view of a third alternative embodiment of a golf club putter.
Figure 11:
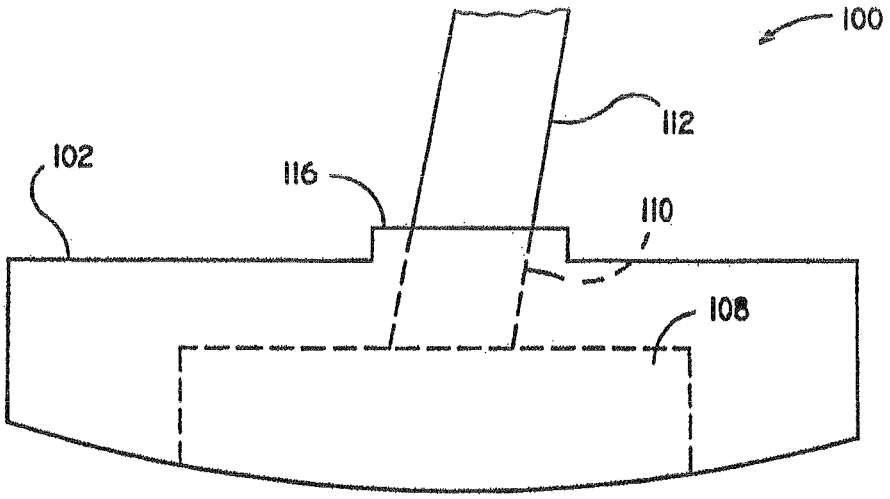
FIG. 11 illustrates a front view of a head for the golf club putter.
Figure 12:
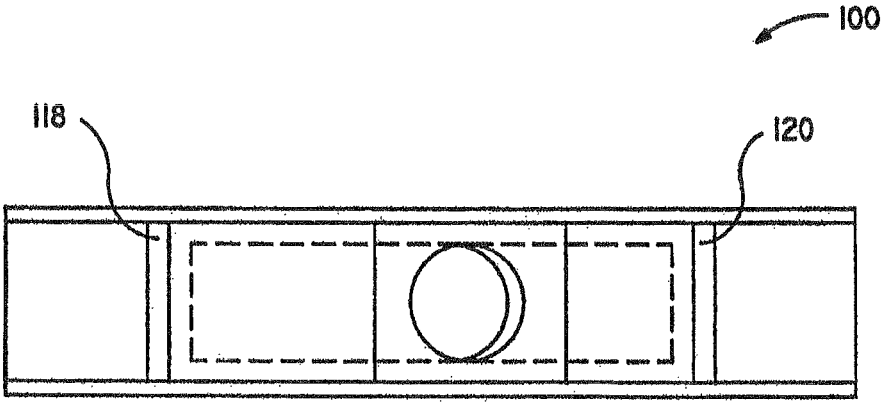
FIG. 12 illustrates a top view of a head of FIG. 11 for the golf club putter.
Figure 13:
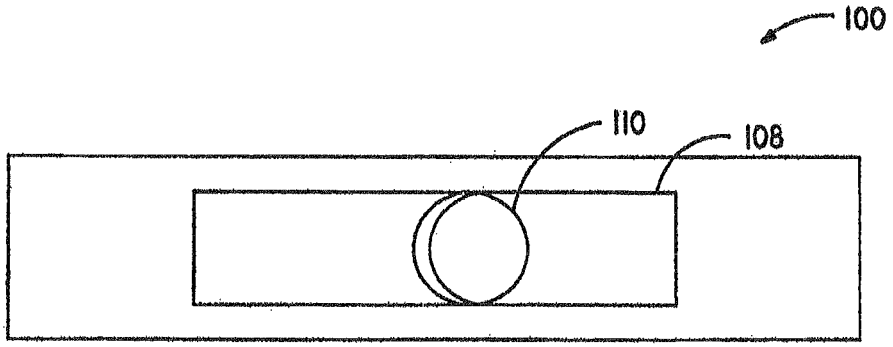
FIG. 13 illustrates a bottom view of the head of FIG. 11 for the golf club putter.
Figure 14:
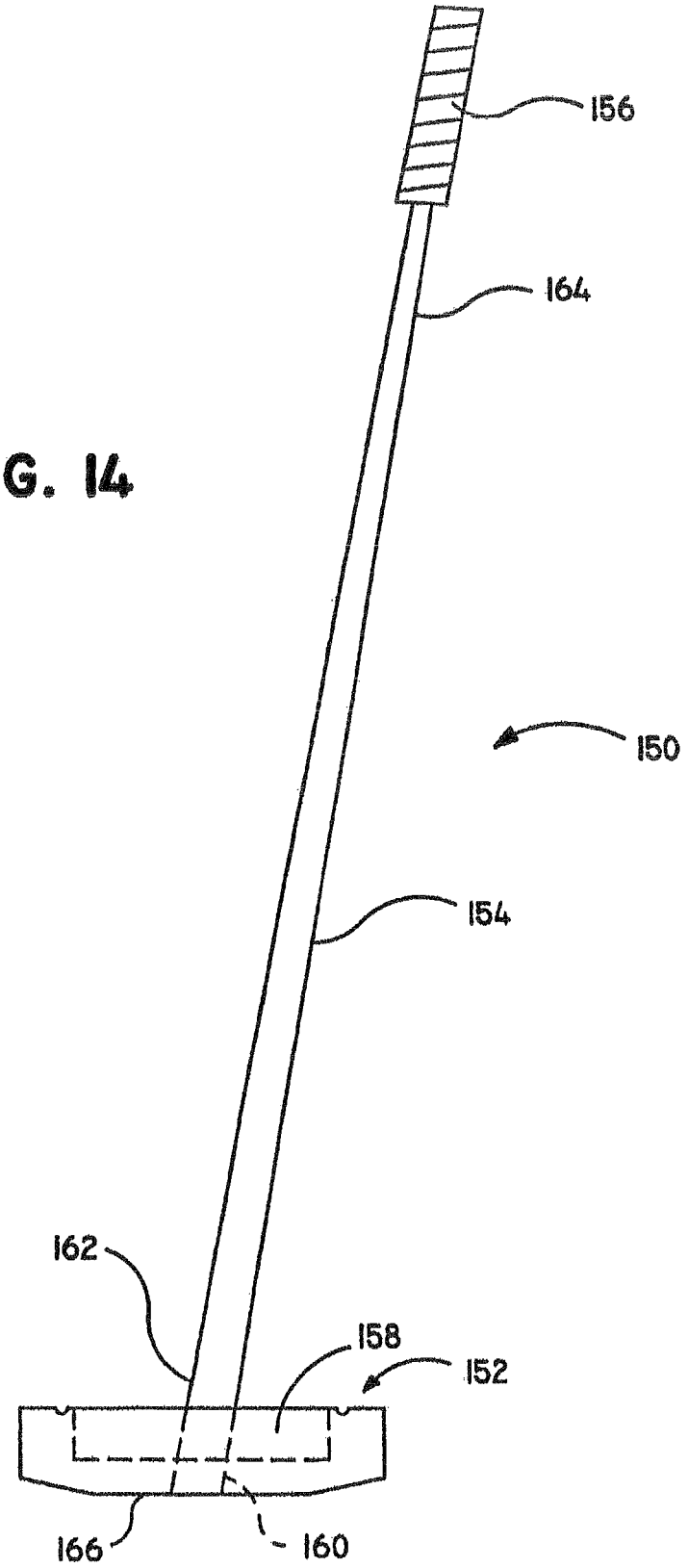
FIG. 14 illustrates a side view of a golf club putter.
Figure 15:
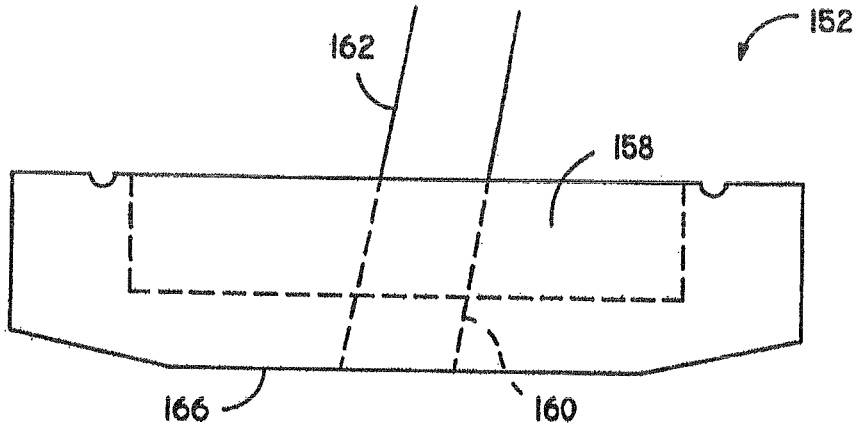
FIG. 15 illustrates a front view of the golf club putter head.
Figure 16:
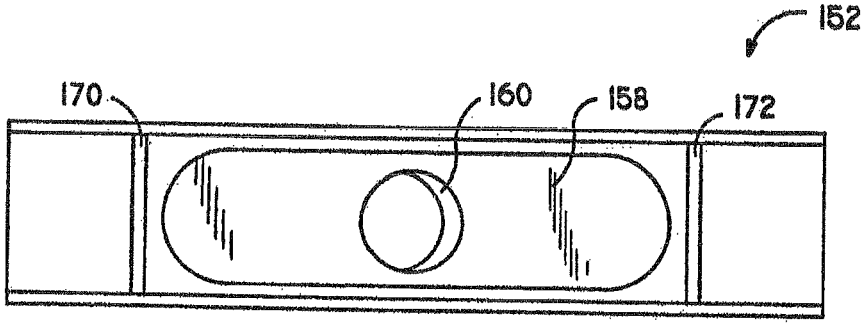
FIG. 16 illustrates a top view of the golf club putter head.
Figure 17:
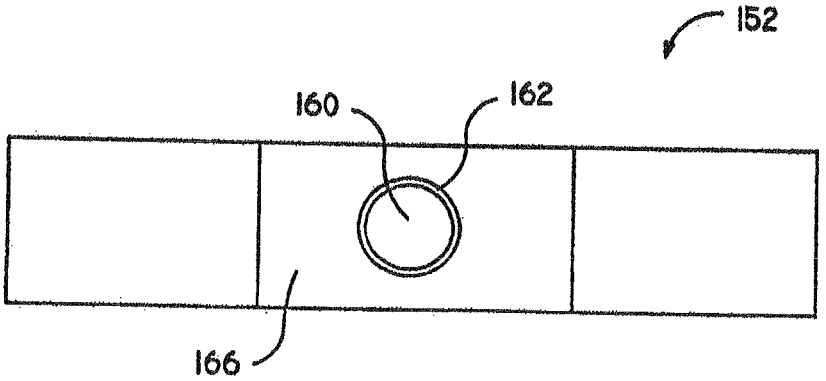
FIG. 17 illustrates a bottom view of the golf club putter head.
Figure 18:
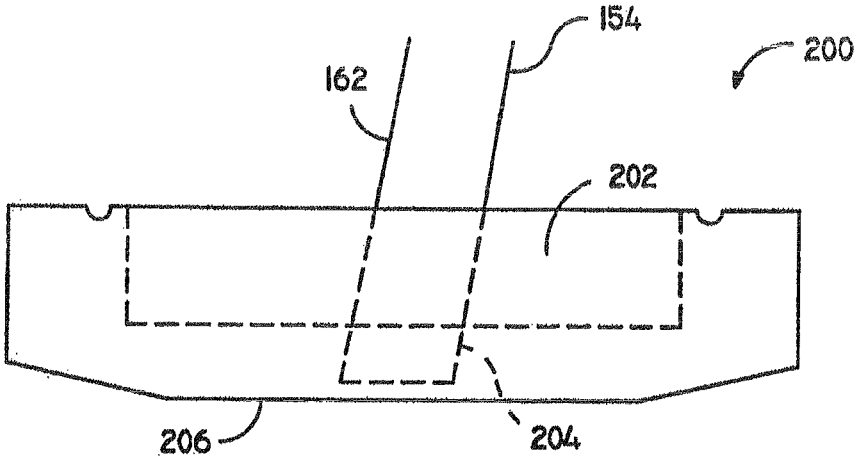
FIG. 18 illustrates a side view of a golf club putter head.
Figure 19:
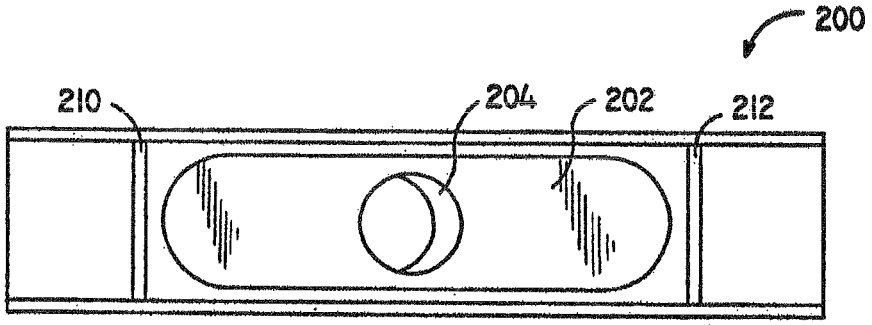
FIG. 19 illustrates a top view of a golf club putter head.
Figure 20:
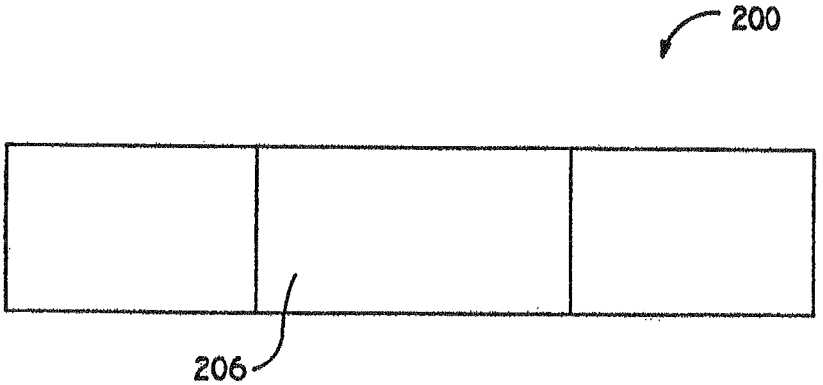
FIG. 20 illustrates a bottom view of a golf club putter head.
Figure 21:
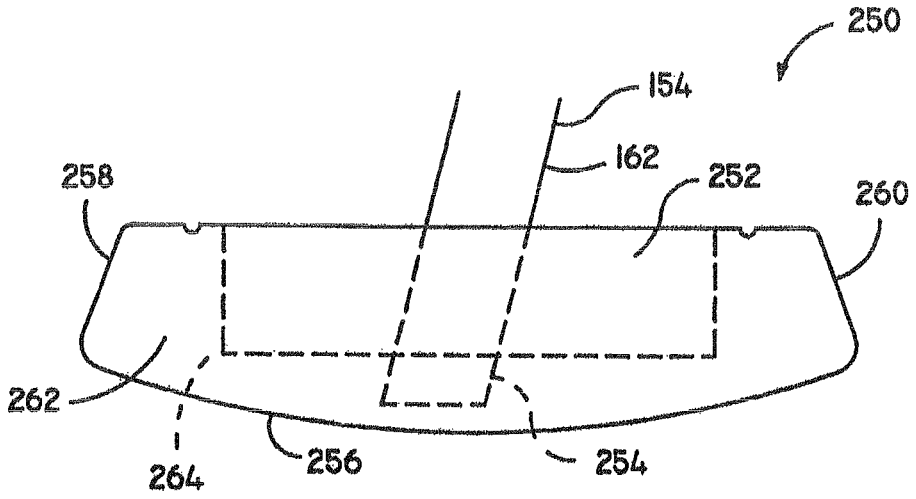
FIG. 21 illustrates a side view of a golf club putter head having beveled ends.
Figure 22:
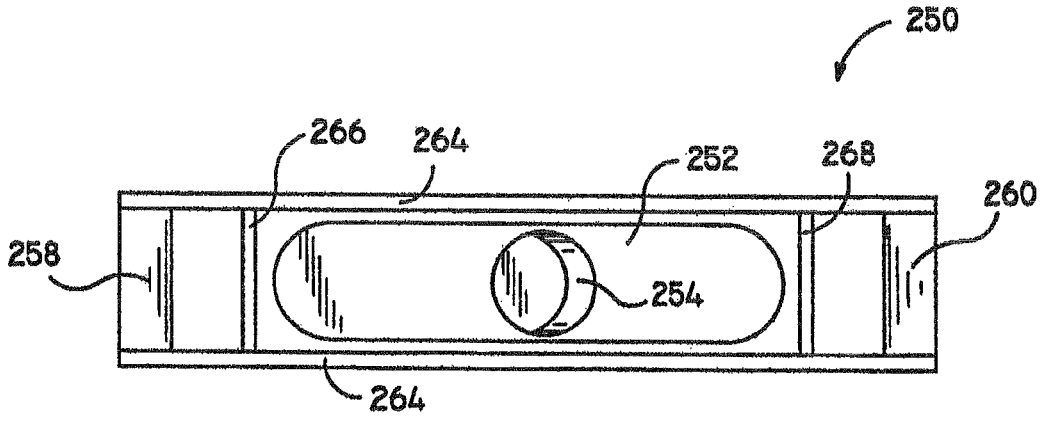
FIG. 22 illustrates a top view of a golf club putter head.
Figure 23:
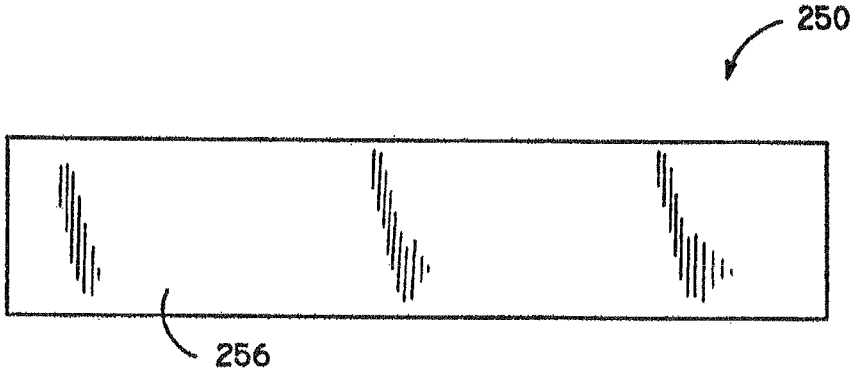
FIG. 23 illustrates a bottom view of a golf club putter head.
Figure 24:
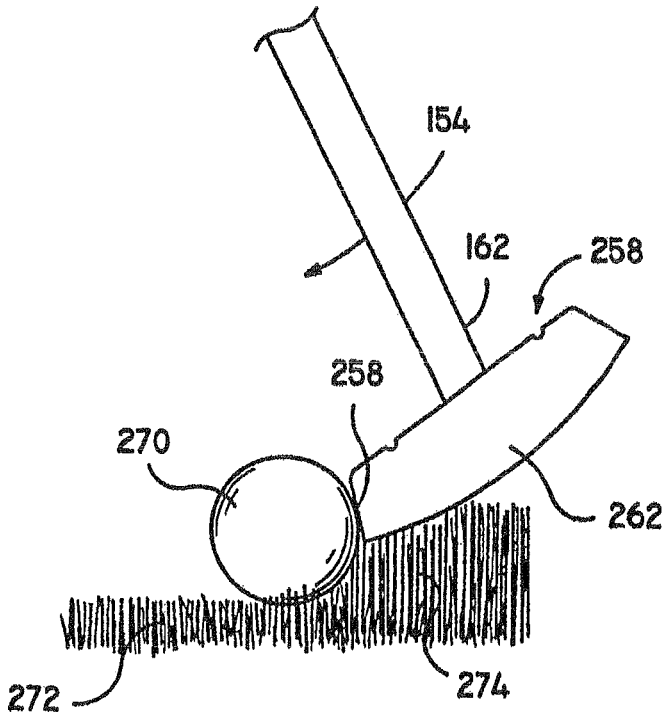
FIG. 24 illustrates the use of the beveled end golf club putter head.

The following is a detailed description of example embodiments of the invention depicted in the accompanying drawings. The example embodiments are in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives failing within the spirit and scope of the present invention, as defined by the appended claims.

The present invention provides a golfer with an ability to impart controlled torque, or torsion in a putt, and/or control the break in a putt to compensate for a putting green sloped to the right or the left. The golf club putter includes a graphite shaft, a fiberglass shaft or a combination of graphite and fiberglass, as distinguished from a metal shaft normally found in putters. As graphite and fiberglass are much lighter than metals such as steel or aluminum, the inventive golf club putter is configured with a center of gravity in the clubhead body, and its graphite shaft formed as a reverse tapered design. To impart the twisting or torque with respect to a central axis, the carbon-fibers comprising the graphite or carbon-fiber reverse tapered graphite shaft are substantially aligned longitudinally, and substantially aligned with the central axis of the shaft.

Preferably, the modulus (i.e., elastic modulus or modulus of elasticity) should be less than the modulus of a conventional graphite shaft, whether embodying a reverse taper design or a more convention shaft design. That is, in view of the fact that the carbon-fiber graphite shaft is intended for use in the inventive golf club putter, high modulus carbon fiber included in driving clubs to impart the required flexibility (enabling proper snap) in not required, lowering shaft cost of manufacture.

In more detail, carbon fiber (alternatively called graphite fibre or carbon graphite) is a material consisting of extremely thin fibers (about 0.005-0.010 mm in diameter) and composed mostly of carbon atoms. Several thousand carbon fibers are twisted together to form a yarn, and may be combined with a plastic resin and molded to form composite materials such as carbon fiber reinforced plastic (also referenced as carbon fiber) to provide a high strength-to-weight ratio material. The properties of carbon fiber such as high tensile strength, low weight, and low thermal expansion. A principal use of high-performance carbon fibers is in sporting goods, such as golf club shafts, tennis rackets, fishing rods, and sailboat structures. The major matrix material for both applications is epoxy.

Carbon fibers are classified by the tensile modulus of the fiber, which is a measure of how much pulling force a certain diameter fiber can exert without breaking (e.g., in pounds of force per square inch of cross-sectional area (psi or Giga Pascal's (CPA))). Modulus is the ratio between stiffness and weight of a graphite shaft. The higher the modulus, the more energy the shaft can store and release. Carbon fibers classified as "high modulus" have a tensile modulus between 350 and 450 Gpa, where "low modulus" have a tensile modulus below 100 Gpa.

Additionally, by widening the graphite shaft near the tip (i.e., implementing the invention with a reverse tapered graphite shaft comprising longitudinally aligned fibers), the twisting capability of the putter's clubhead is further increased. This increases torsion is realized because a wider diameter with thin shaft walls will twist more readily than a narrow diameter with thick shaft walls.

Adding a center-shafted putter club head with a centrally balanced center of gravity about the lower modulus, reverse tapered graphite shaft imparts the intended effect on the golf ball. That is, the inventive golf club putter so designed enables a golfer to strike the ball off the toe to impart a clockwise spin on the ball and reduce any break to the left that might be imposed by a left sloping green. In addition, where the golfer is confronted with a green that slopes to the right, the inventive golf club putter so designed enables striking the ball off the heel to impart a counter clockwise spin on the ball and reduce any break to the right. Reducing break in a putt makes it easier to make the putt.

While the above-description is directed to club constructed for use by right-handed golfers, the principles are readily applied to clubs for use by left-handed golfers. Applying the inherent principles simply requires replacing "toe" with "heel," and "heel" with "toe," to realize the inventive clubs optimized for use by left-handed golfers.

Figure 25A:
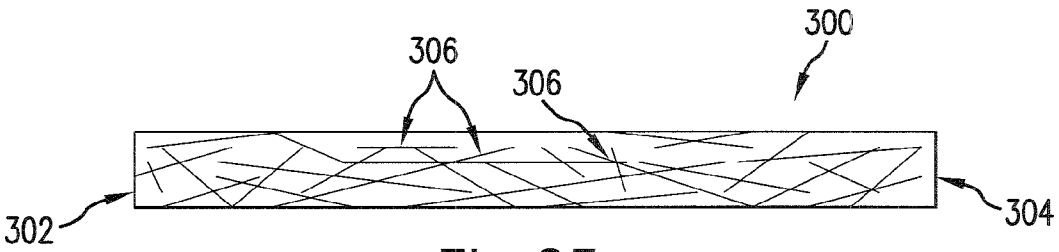
FIG. 25*a* illustrates a straight graphite shaft constructed to display a high modulus.
Figure 25B:
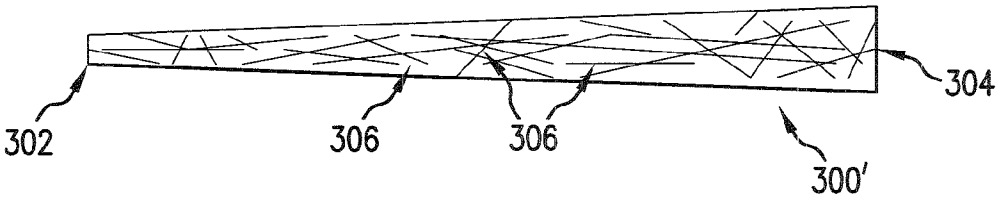
FIG. 25*b* illustrates a conventionally tapered graphite shaft constructed to display a high modulus.
Figure 25C:
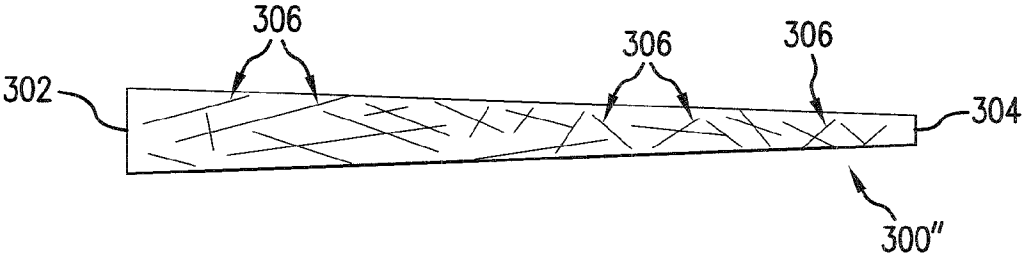
FIG. 25*c* illustrates a reverse-tapered graphite shaft constructed to display a high modulus.

FIGS. 25*a*, 25*b* and 25*c* depict known graphite shafts 300, 300' and 300", which are constructed with high modulus carbon fibers 306. These high modulus carbon fibers are not aligned, realizing a matrix/shaft with high modulus. The graphite shaft 300 in FIG. 25*a* is a straight shaft (no taper) between end 302, to which attaches a clubhead, and end 304, to which attaches a grip portion of a conventional golf club. The graphite shaft in FIG. 25*b* is a CONVENTIONAL tapered shaft, where end 302 typically attaches to the clubhead and wider end 304, typically attaches to a grip portion. The graphite shaft in FIG. 25*c* is a reverse-tapered shaft, where wider end 302 attaches to the clubhead and narrower end 304, attaches to a grip portion of the reverse tapered golf club.

Figure 26A:
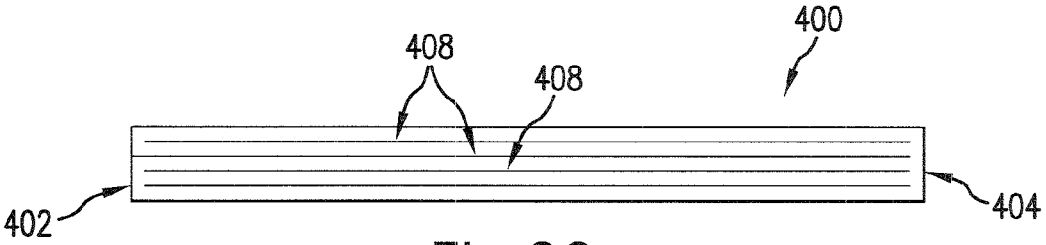
FIG. 26*a* illustrates a straight graphite shaft constructed with longitudinally aligned carbon fibers to realize a shaft that displays a high modulus.
Figure 26B:
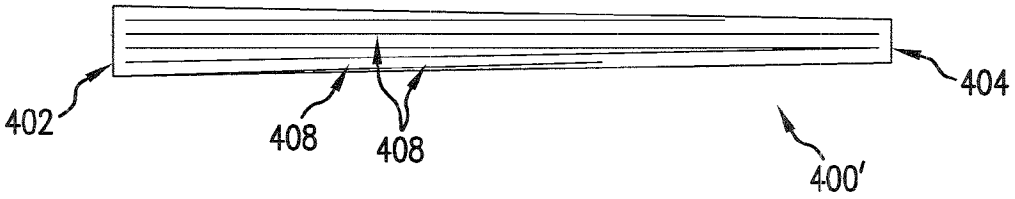
FIG. 26*b*, illustrates a reverse-tapered graphite shaft constructed with longitudinally aligned carbon fibers to realize a shaft that displays a low modulus.
Figure 26C:
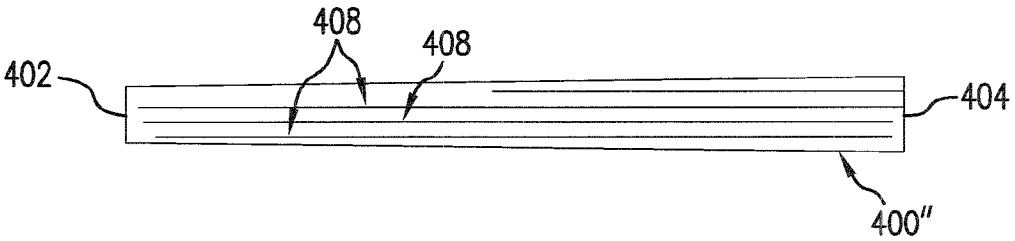
FIG. 26*c*, illustrates a reverse-tapered graphite shaft constructed with longitudinally aligned carbon fibers to realize a shaft that displays a low modulus, which is a mirror image of the shaft depicted in FIG. 26*b;*

FIGS. 26*a*, 26*b* and 26*c* depict graphite shafts 400, 400' and 400", which are constructed with low modulus carbon fibers 406 that are arranged to be substantially aligned, and substantially aligned to a central axis of the respective shafts, in accordance with the inventive principles. These aligned low modulus carbon fibers realize a matrix/shaft with a low modulus. The graphite shaft 400 in FIG. 26*a* is a straight shaft (no taper) between end 402, to which attaches a clubhead, and end 404, to which attaches a grip portion of a golf club. The graphite shaft 400' in FIG. 26*b* is a reverse tapered shaft, where wider end 402 is intended to attach to a clubhead and narrower end 404 is intended to attach to a grip portion of a reverse tapered golf club. The graphite shaft in FIG. 26*c* is a tapered shaft, where narrower end 402 is intended to attach to a clubhead and wider end 404 is intended to attach to a grip portion of a golf club.

Figure 27A:
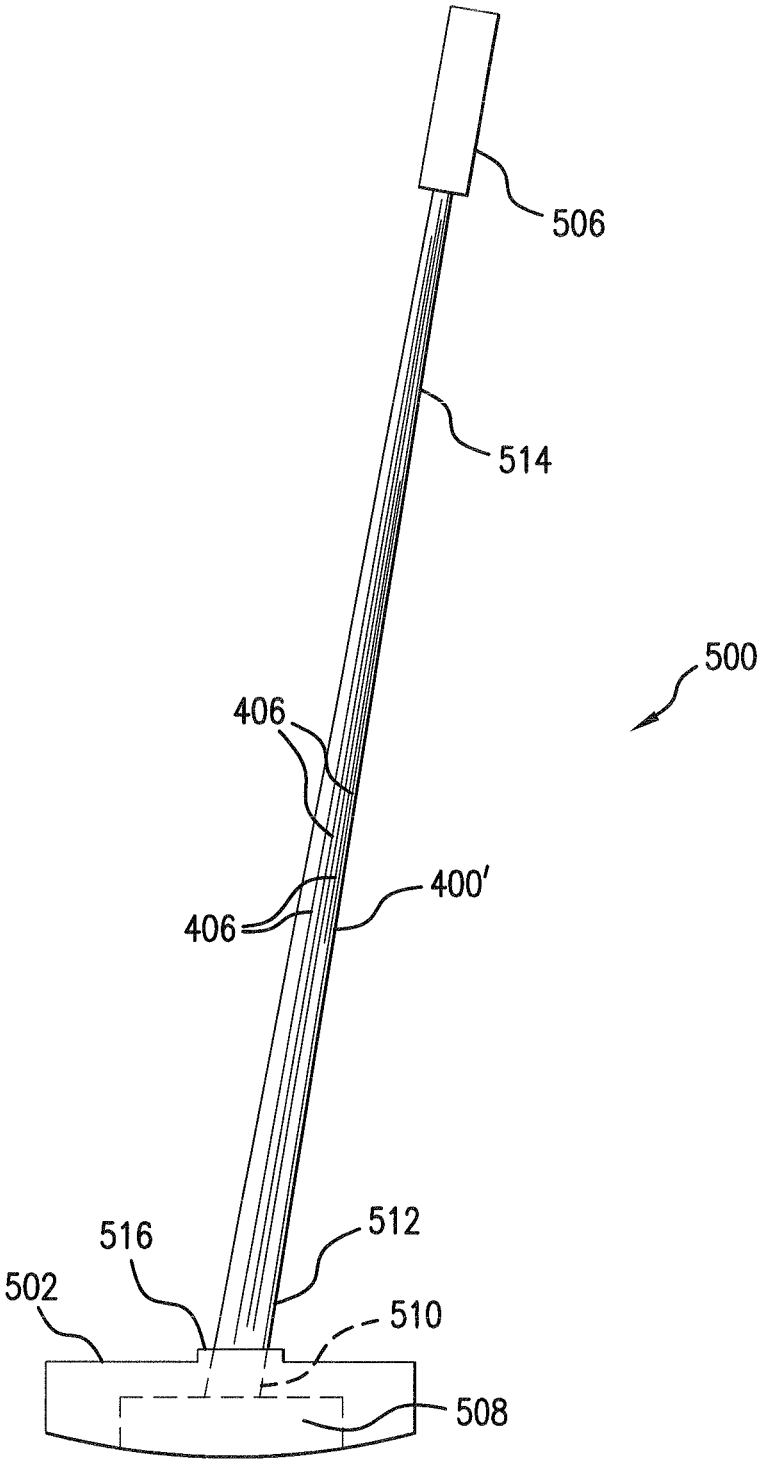
FIG. 27*a* illustrates a golf club putter configured with a reverse-tapered graphite shaft displaying longitudinally aligned carbon fibers, with a hollow area in the club head to adjust the center of gravity.

FIG. 27*a* is a side view of a low modulus, graphite, reverse tapered golf club putter 500 of the invention. Putter 500 includes a clubhead 502, a reverse tapered shaft 400' (with graphite fibers substantially aligned and substantially aligned with a central axis of the shaft), and a grip 506. A hollow area 508 is provided in the clubhead 502. A hole 510 is provided to engage with the reverse tapered shaft 400'. The thick (wider) end 512 of the reverse tapered shaft 400' engages into the hole 510, and the thin (narrower) end 514 of the shaft 400' engages into the grip 506. Preferably, an upwardly extending member 516 provides further support for the thick end 512 of the reverse tapered shaft 400'. The reverse tapered shaft 400' is inserted through the head 510 at a true center of gravity, for optimized balance. The hollow area 508 can be filled with any suitable material, such as material of a different density than that of the material the clubhead 502.

Figure 27B:
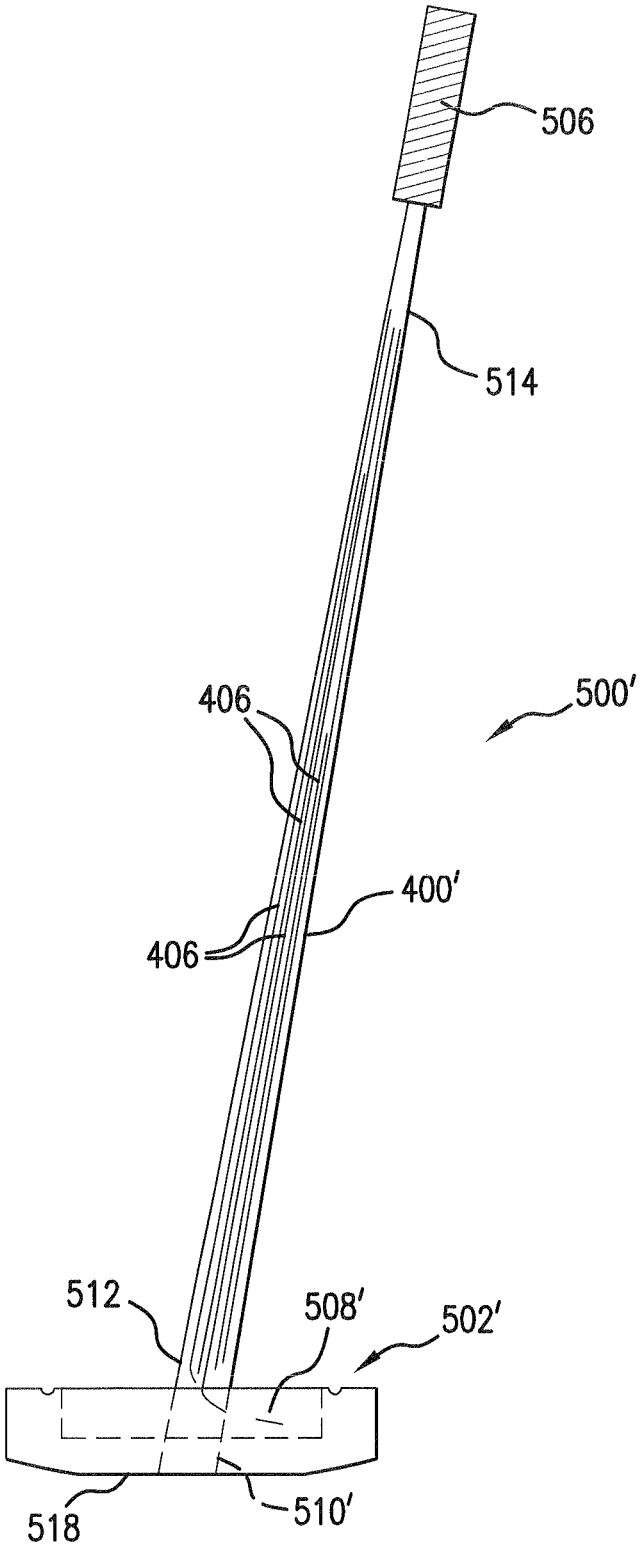
FIG. 27*b* illustrates an alternative embodiment to the FIG. 27*a* golf club putter.

FIG. 27*b* is a side view of a low modulus, graphite, reverse tapered golf club putter 500' of the invention. In the FIG. 27*b* embodiment, clubhead 502' includes a hollow area 508' in an upper region, as shown. Shaft mounting hole 510' extends to a bottom surface 518 to engage the reverse tapered shaft 400'. The thick (wider) end 512 of the reverse tapered shaft 400' engages the shaft mounting hole 510' and the thin (narrower) end 514 engages the grip portion 506. The reverse tapered shaft 400' is inserted through the shaft mounting hole 510' at a true center of gravity (but see FIGS. 28*a*, 28*b* and explanation of alternative embodiments, below). The hollow area 508' can be filled with any suitable material, such as material of a different density than that of the material of the clubhead 502'.

Figure 27C:
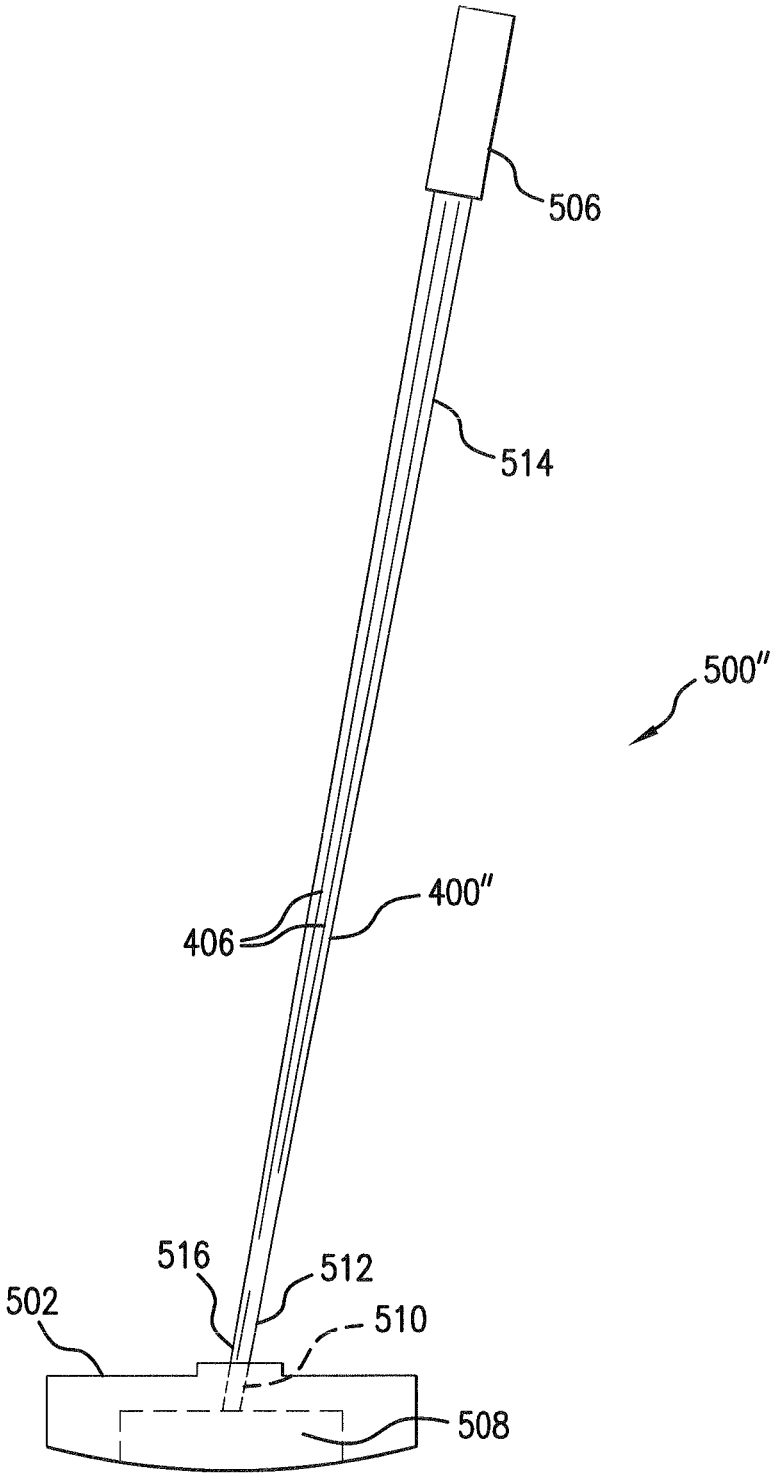
FIG. 27*c* illustrates a golf club putter configured with a tapered graphite shaft displaying longitudinally aligned carbon fibers, with a hollow area in the club head to adjust the center of gravity; and, FIG. 27*d* illustrates a golf club putter configured with a graphite shaft (without a taper) displaying longitudinally aligned carbon fibers, with a hollow area in the club head to adjust the center of gravity.

FIG. 27*c* is a side view of a low modulus, graphite, tapered golf club putter 500" of the invention. Putter 500" includes a clubhead 502, a tapered shaft 400" (with graphite fibers substantially aligned and substantially aligned with a central axis of the shaft), and a grip 506. A hollow area 508 is provided in the clubhead 502. A hole 510 is provided to engage with the tapered shaft 400'. The thin (narrower) end 512 of the tapered shaft 400" engages into the hole 510, and the thick (wider) end 514 of the tapered shaft 400" engages into the grip 506. Preferably, an upwardly extending member 516 provides further support for the thin end 512 of the tapered shaft 400". The tapered shaft 400" is inserted through the head 510 at a true center of gravity, for optimized balance in the embodiment shown (but see FIGS. 28*a*, 28*b* and explanation of alternative embodiments, below). The hollow area 508 can be filled with any suitable material, such as material of a different density than that of the material the clubhead 502.

Figure 27D:
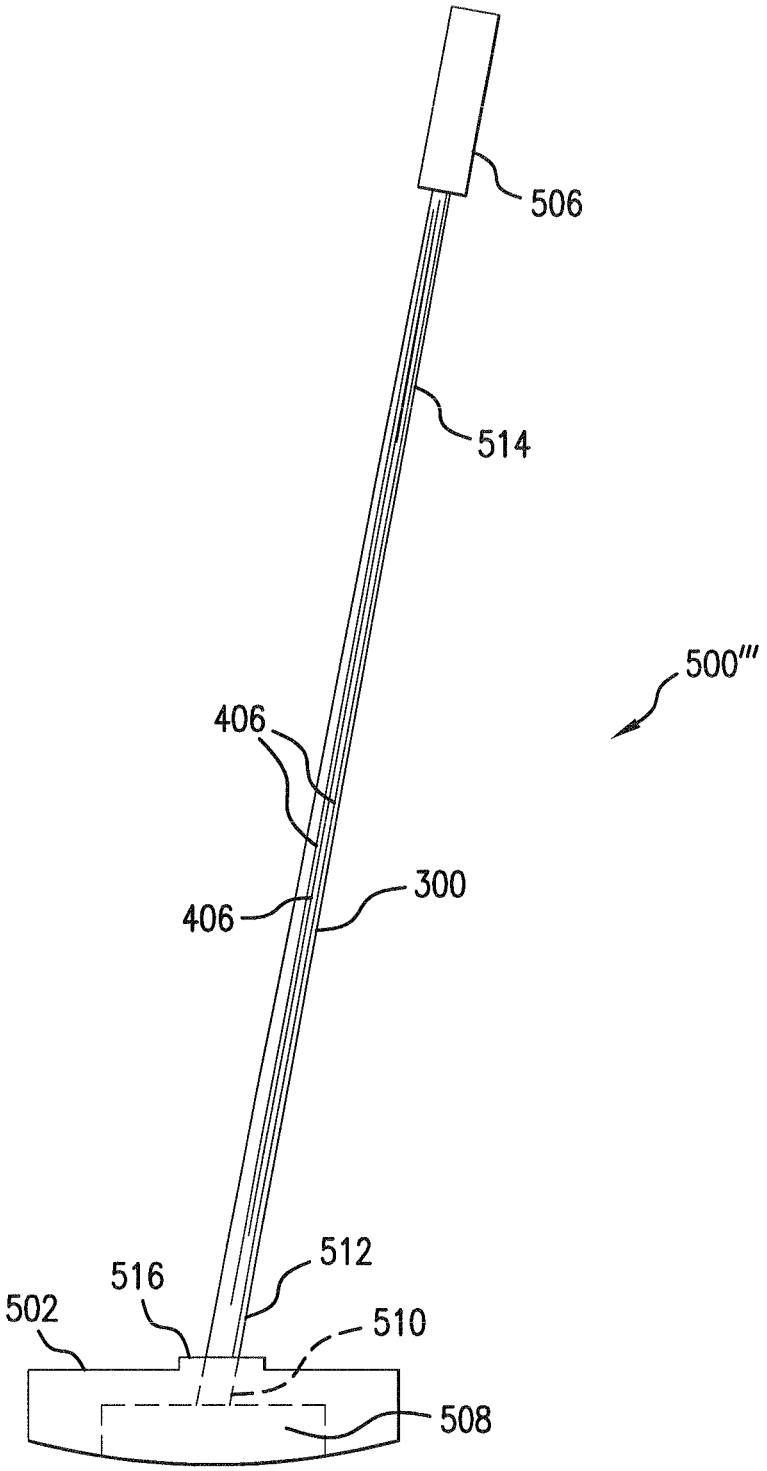

FIG. 27*d* is a side view of a low modulus, graphite golf club putter 500'" of the invention formed without a taper. Putter 500" includes a clubhead 502, a substantially straight shaft 300 (with graphite fibers substantially aligned and substantially aligned with a central axis of the shaft), and a grip 506. A hollow area 508 is provided in the clubhead 502. A hole 510 is provided to engage with the shaft 300. Shaft end 512 of the shaft 400" engages into the hole 510, and end 514 of the shaft 300 engages into the grip 506. Preferably, an upwardly extending member 516 provides further support for the end 512. The shaft 300 is inserted through the head 510 at a true center of gravity, for optimized balance (but see FIGS. 28*a*, 28*b* and explanation of alternative embodiments, below). The hollow area 508 can be filled with any suitable material, such as material of a different density than that of the material the clubhead 502.

Figure 28A:
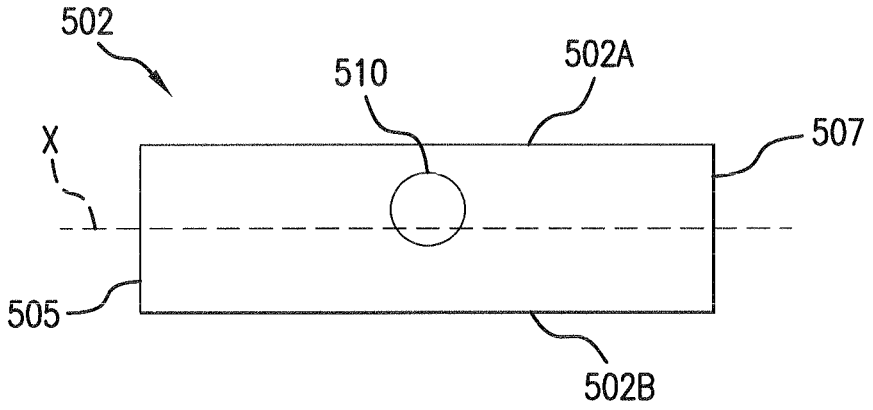
FIG. 28*a* illustrates a clubhead with a shaft receiving hole that is off-center; and, FIG. 28*b* illustrates a clubhead with a shaft receiving hole that is off-center on an opposite side with respect to the embodiment depicted in FIG. 28*a.*
Figure 28B:
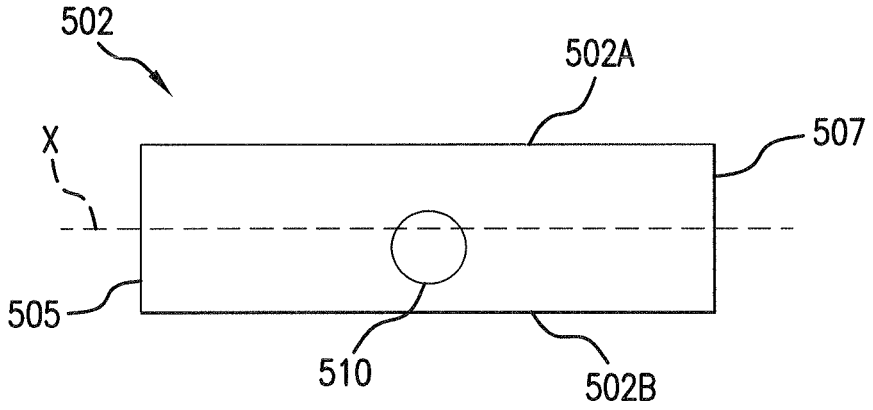

Alternatively, the tip end of the composite shaft (in any of the embodiment shown in FIGS. 27*a*, 27*b*, 27*c*, and 27*d*) may be positioned in the clubhead body at a location 510. The center of which being equidistant from the toe or heel (505, 507), but closer to one clubhead face 502A than the other clubhead face 502B. A central axis X of the clubhead 502 is depicted in FIGS. 28*a* and 28*b* extending between each respective toe/heel, where the center of hole 510 is closer to clubhead face 502A in FIG. 28*a* and closer to clubhead face 502B in FIG. 28*b*. The respective arrangements change the respective centers of gravity of the clubheads thereby enabling the composite golf club putters constructed with same to be used with either left-handed or right-handed golfers.

In an embodiment, the inventive golf club is manufactured as a composite golf club putter. The composite golf club comprises a clubhead body sufficiently weighted to define a center of gravity of the golf club and composite shaft elongated along a central axis. As described, the composite shaft may be tapered along its length with a diameter that is larger at clubhead than at the handle, vice versa or none at all. In any case, the composite shaft comprises longitudinally oriented fibers in an arrangement that enables shaft torsional distorting forces imposed at the grip end during putting to be imparted to the clubhead and a golf ball thereby.

In the composite golf club putter, the composite may be graphite, fiberglass and both and the fibers may be graphite fibers, fiberglass fibers and both. For that matter, the graphite composite preferably has a strength and stiffness in psi within ranges of $4\text{-}9\times10^4$ and $7\text{-}10\times10^6$ respectively, a density of about 0.5 lbs/square inch, a specific strength and a specific stiffness in ranges of about $1\text{-}2\times10^6$ and $150\text{-}210\times10^6$, respectively and a CTE in in/in-F of about $1\text{-}2\times10^{-6}$. The fiberglass composite preferably has a strength and stiffness in psi within ranges of $2\text{-}4\times10^4$ and $1\text{-}2\times10^6$ respectively, a density of about 0.55 lbs/square inch, a specific strength and a specific stiffness in ranges of about $3\text{-}7\times10^5$ and $15\text{-}30\times10^6$, respectively and a CTE in in/in-F of about $6\text{-}8\times10^{-6}$.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

What is claimed is:

1. A composite golf club putter, comprising:

a putter head sufficiently weighted to define a center of gravity of the golf club, the putter head comprises a toe, a heel, and a center section, the center of gravity being at the center section approximately equidistant from the toe and the heel; and a putter shaft elongated along a central axis between a tip end and a grip end, the tip end attaches to the putter head at the center of gravity, the putter head and the putter shaft are configured to impart spin on a golf ball during a putting stroke to reduce breaking;

wherein the putter shaft comprises substantially continuous unitary fibers longitudinally oriented around a hollow center, the continuous unitary fibers disposed from the tip end to the grip end, the continuous unitary fibers are characterized by a low modulus of elasticity and a low torsional resistance, the continuous unitary fibers are embedded in composite matrix in an arrangement that enables shaft torsional distorting force imposed during the putting stroke to be imparted through the putting shaft to the putting head and a golf ball thereby to impart the spin when the golf ball is struck with the putter at one of the toe and the heel of the putter head.

2. The composite golf club putter of claim 1, wherein the composite shaft is substantially cylindrical, with shaft walls surrounding a hollow center.

3. The composite golf club putter of claim 1, wherein the shaft walls are of a thickness equivalent to a range of between ¼ and 1/10 of the shaft radius.

4. The composite golf club putter of claim 1, wherein the composite comprises material from any of the group consisting of graphite, fiberglass and both and wherein the fibers comprise any of the group consisting of graphite fibers, fiberglass fibers and both.

5. The composite golf club putter of claim 1, wherein a tip end of the putter shaft is positioned in the putter head at a location that is approximately equidistant from the toe and the heel but closer to one putter head face than the other putter head face.

6. The composite golf club putter of claim 5, wherein the longitudinally oriented fibers and the position of the tip end in the putter head enable shaft torsional distorting forces imposed during putting to be transmitted to a striking surface of the putter head in such a way that, depending on whether the putter head striking surface strikes a golf ball, from the left or right, and at the toe or heel of the putter head, a spin is imparted to the golf ball.

7. A composite golf club putter, comprising:

a putter head sufficiently weighted to define a center of gravity of the golf club, the putter head comprises a toe, a heel, and a center section, the center of gravity being at the center section approximately equidistant from the toe and the heel; and a putter shaft elongated along a central axis between a tip end and a grip end, the tip end attaches to the putter head at the center of gravity, the putter head and the putter shaft are configured to impart spin on a golf ball during a putting stroke to reduce breaking;

wherein the putter shaft comprises substantially continuous unitary fibers longitudinally oriented around a hollow center, the continuous unitary fibers disposed from the tip end to the grip end, the continuous unitary fibers are characterized by a low modulus of elasticity and a low torsional resistance, the continuous unitary fibers are embedded in a composite matrix in an arrangement that enables shaft torsional distorting forces to be generated when putting a golf ball off-center and wherein the shaft torsional distorting forces in turn impose a spin on the golf ball, and wherein no spin is imparted when the golf ball is struck at the center.

* * * * *